US005356190A

United States Patent [19]

Torres

[11] Patent Number: 5,356,190

[45] Date of Patent: Oct. 18, 1994

[54] PLASTIC BAG HANDGUARD

[76] Inventor: Daniel S. Torres, 17270 Torrey Ct., Morgan Hill, Calif. 95037

[21] Appl. No.: 105,015

[22] Filed: Aug. 10, 1993

[51] Int. Cl.[5] ..... A45C 13/26; B65D 33/06

[52] U.S. Cl. ..... 294/171; 294/166

[58] Field of Search ..... 294/137, 153, 166, 170, 294/171; 16/114 R, 114 B; 229/117.19, 117.23–117.25; 383/6, 13, 25, 29

[56] References Cited

U.S. PATENT DOCUMENTS

| | | | |
|---|---|---|---|
| D. 268,815 | 5/1983 | Schwalbach . | |
| 736,632 | 8/1903 | Priddat | 294/171 |
| 1,028,489 | 6/1912 | Priddat | 294/171 |
| 1,468,848 | 9/1923 | Wear | 294/171 X |
| 2,717,411 | 9/1955 | Taipale . | |
| 2,846,714 | 8/1958 | Charlick . | |
| 3,083,366 | 3/1963 | Franges . | |
| 3,912,140 | 10/1975 | Franges | 294/171 X |
| 3,913,172 | 10/1975 | Richards et al. . | |
| 4,004,722 | 1/1977 | Olivier | 294/171 |
| 4,590,640 | 5/1986 | Enersen . | |
| 4,796,940 | 1/1989 | Rimland . | |
| 4,846,519 | 7/1989 | Leonard . | |
| 4,890,355 | 1/1990 | Schulten . | |
| 4,902,060 | 2/1990 | Nobakht . | |
| 4,923,235 | 5/1990 | Stewart . | |
| 4,936,619 | 6/1990 | Salazar . | |
| 4,982,989 | 1/1991 | Sweeny . | |
| 5,005,891 | 4/1991 | Lunsford | 294/171 |
| 5,029,926 | 7/1991 | Dieterich, Jr. . | |

FOREIGN PATENT DOCUMENTS

| | | | |
|---|---|---|---|
| 197272 | 4/1958 | Austria | 294/171 |
| WO88/06128 | 8/1988 | European Pat. Off. . | |
| 3347410 | 7/1985 | Fed. Rep. of Germany | 294/171 |
| 3347410A1 | 7/1985 | Fed. Rep. of Germany . | |
| 3842313 | 6/1990 | Fed. Rep. of Germany | 294/171 |
| 611423 | 9/1926 | France | 294/171 |
| 2661323 | 10/1991 | France | 294/171 |
| 2123280A | 2/1984 | United Kingdom . | |
| 2135179A | 8/1984 | United Kingdom . | |
| 2135179 | 8/1984 | United Kingdom | 294/171 |
| 2147200A | 5/1985 | United Kingdom . | |

*Primary Examiner*—Johnny D. Cherry
*Attorney, Agent, or Firm*—Thomas C. Feix

[57] ABSTRACT

A handguard for plastic bags and like carrying items having thin loop-type handles which includes a planar palm guard member connected by a U-shaped bridging member to a finger guard portion. In vertical elevation, the palm, bridge and finger guard form a J-shape assembly. The handguard further includes a planar keeper which is joined at its upper edge to an upper end region of the palm guard to form a rigid hinge which forces the planar keeper outwardly in a sprung-open position so that the lower edge of the keeper is retained by the upper edge of the finger guard portion. In use, the handguard is held generally vertically in the user's hand with the palm portion resting against the user's palm and the U-shaped bridging member supported by the user's fingers. The loops of the plastic grocery bags are then picked up so that they are received within the trough of the U-shaped bridge member. The keeper flap is sufficiently flexible so that it is very easy to slip the grocery bag loops into the handguard yet is normally biased to the closed position to ensure that the handguard will not become unintentionally separated from the bag handles when the bag is set down.

20 Claims, 2 Drawing Sheets

PLASTIC BAG HANDGUARD

BACKGROUND OF THE INVENTION

1. Field of the Invention

The present invention relates to hand protecting grips or handguards for use with hand held articles having thin handles or loops for carrying, such as plastic shopping bags, and more particularly to a plastic bag handguard that provides convenient installation and removal of one or more items and which is economical to produce.

2. Description of the Prior Art

Many products currently in the market place are packaged or loaded into containers having thin, narrow handles of various types. For example, large paint cans have thin wire handles, and the increasingly popular plastic grocery bags have thin ribbon-like carrying handles or loops which can cause significant discomfort to the hand. In spite of the irritation caused by these items, very few people bother with providing any kind of hand protection.

Handguards for plastic shopping bags have been the subject of patents, but for various reasons the devices are not widely used. For example, in U.S. Pat. No. 5,029,926 issued to Dieterich, Jr., a trough-like device with slots in the ends is disclosed. This device includes a pair of overlapping tabs at opposed ends of the handguard for retaining the handguard to the straps or handles of the plastic bag. A disadvantage with this device is that it requires two handed manipulation to detach the handguard from the loop handles of the plastic bag. A similar device is also disclosed in U.S. Pat. No. 4,923,235 issued to Stewart. In Stewart, however, the tabs of the opposed ends do not completely overlap thus permitting the handguard to became separated from the plastic bag handles when the bag is set down. This is undesirable for the case where the user sets down the bags for only a short time and intends to pick them up again, for example, after placing the bags in a car trunk during a shopping trip and then carrying the bags from the car to the home. A cylindrical grip with a longitudinal slot is disclosed in U.S. Pat. No. 4,846,519 issued to Leonard. Similar to the Stewart device, the presence of the slot in the Leonard handguard permits the handguard to fall off or become unintentionally separated from the plastic bag when the bag is set down.

Accordingly, despite the number of patented handguards which exist, there remains an apparent need for an improved handguard that isn't being met. First and foremost, the preferred handguard should be inexpensive to manufacture and should be durable for repetitive use. It is also desirable that the handguard be small in size so that it is easy to carry unobtrusively, in a shirt pocket for example. The handguard should also be designed to evenly distribute bag load over the gripping fingers of a user so as not to cut or cause discomfort to the user's hand. An ideal handguard should also be able to securely engage a number of plastic grocery bags, with installation and removal requiring little or no effort.

SUMMARY OF THE INVENTION

It is therefore an object of the present invention to provide a handguard for plastic bags and like carrying articles having thin straps or loops which is easy to use and which is inexpensive to manufacture.

It is another object of the invention to provide a handguard for plastic bags which can be used to lock a bag's carrying loop together, even when the bag is set down, thus reducing potential spillage of the bag's contents, comfortably allowing higher item count per bag.

It is another object of the invention to provide a handguard for plastic bags which can lock and group two or more bags together.

It is another object of the invention to provide a handguard for plastic bags which is designed to evenly distribute bag load over the gripping fingers and provide sufficient gripping surface area so as not to cut the user's fingers.

It is yet another object of the present invention to provide a handguard that makes installation and removal nearly effortless, especially by older persons or others With diminished hand strength.

Briefly, a preferred embodiment of the present invention includes a handguard comprising a substantially planar palm guard which is connected by a U-shaped bridging member to a finger guard portion. In vertical elevation, the palm guard, bridge member and finger guard form a J-shape assembly. The handguard also includes a planar keeper which is joined at its upper edge to the upper end of the palm guard to form a rigid top hinge.

The entire assembly is preferably made of rigid plastic, and may be injection molded in final form, or fabricated of sheet material which is then heat formed to provide the curved bridge between the finger guard and the palm guard portion and the rigid top hinge between the palm guard and planar keeper.

The top hinge forces the planar keeper outwardly in a sprung-open position so that the lower edge of the keeper is retained by the overlapping upper edge of the finger guard portion. The width of the assembly is approximately the distance between the first and little fingers of a normal size adult human hand, on the order of 2½ to 3 inches. The side edges of the bottom of the U-shaped bridge can be slightly flared downward so that the handguard does not cut the plastic bags. Likewise, the outer edges of the palm guard portion and U-shaped bridging member can be curled inwardly slightly for comfort so that the unit does not cut the hand. Optionally, there can be a hole through the palm guard and/or both and the keeper flap so that the unit can be conveniently hung from a hook for retail display or for storage at home when not in use.

In operation, the handguard is held generally vertically in the user's hand with the palm portion resting against the user's palm and the U-shaped bridging member supported by the user's fingers. The loops of the plastic grocery bags are then picked up so that they are received within the inner trough of the U-shaped bridge member. The keeper flap is sufficiently flexible so that it is very easy to slip the grocery bag loops into the handguard. The keeper is short enough, and the finger guard is long enough so that the bottom edge of the keeper is not caught by the gathered plastic of the loops of the grocery bag.

Further, after carrying the grocery bags out from the store to one's automobile, the handguard can be left engaged to the loops. The keeper flap ensures that the handguard will not fall off and get lost between the bags or in the bags of groceries. Thus, when the shopper gets home, the handguard is still engaged to the plastic loops of the grocery bags, and the user can carry them into his/her residence.

An advantage of the present invention is that it is easily and economically formed from a single rectangular piece of plastic material.

A further advantage is that it is relatively flat in configuration and can be conveniently carried in a shirt pocket, etc., and has a large flat space for advertising or decorative designs.

Another advantage of the present invention is that handles can be easily inserted and removed with single hand operation.

These and other objects and advantages of the present invention will no doubt become apparent to those skilled in the art after having read the following detailed description of a preferred embodiment illustrated in the several figures of the drawing.

Figure 1A:
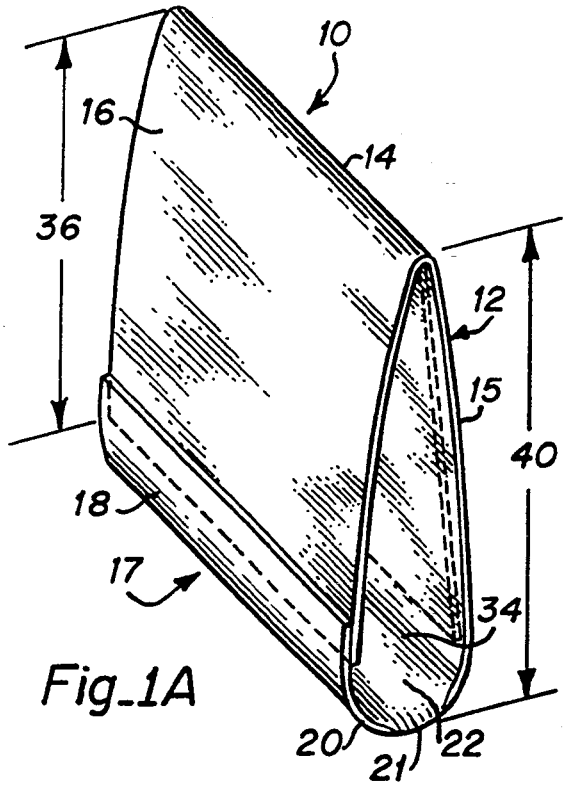
FIG. 1A is a perspective view of a handguard constructed in accordance with one embodiment of the present invention.
Figure 1C:
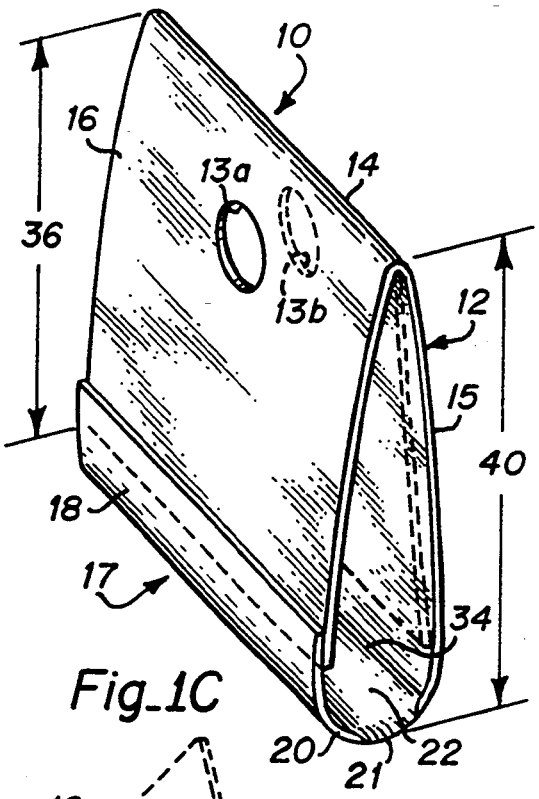
FIG. 1C is a perspective view of handguard similar to FIG. 1A and showing further modifications.

As best seen in FIG. 1C, one or more optional holes 13*a*, 13*b*.

DETAILED DESCRIPTION OF THE PREFERRED EMBODIMENT

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 1B:
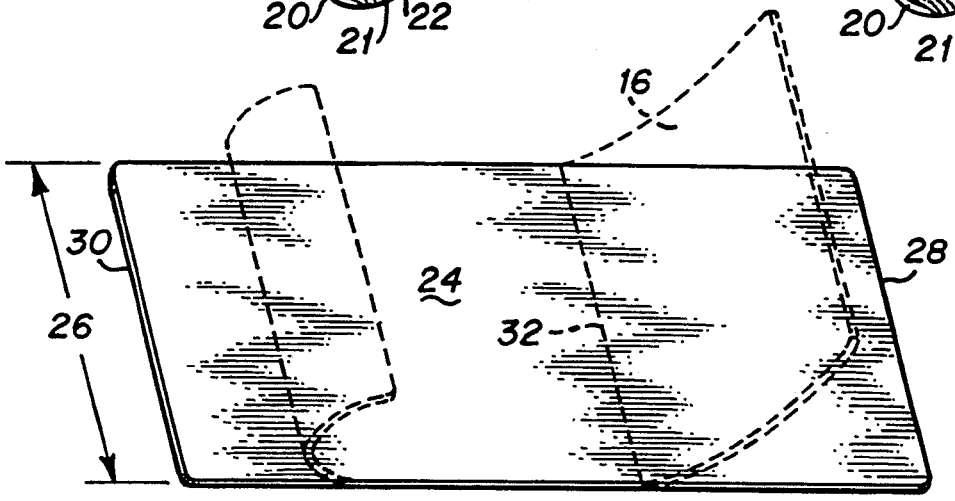
FIG. 1B is a perspective view showing the method of manufacture of the handguard of FIG. 1A.

Referring now to FIGS. 1A and 1B of the drawing, there is depicted a preferred embodiment of the present invention. FIG. 1A shows a handguard 10 having a back or palm guard portion 12, a top radius or rigid hinge 14, a keeper flap 16, and a lower portion 17 including a finger guard 18 connected to the palm guard 12 by a U-shaped bridge member 20 which forms an inner trough 22. The handguard 10 preferably comprises rigid plastic material and can be manufactured in a number of ways known to those skilled in the 23 related arts, including injection molding and heat forming methods may be formed in the keeper flap 16 and/or palm guard 12 for hanging the handguard 10 on a hook for storage or retail display. The side edges 21 of the trough 22 are preferably flared downwardly so that the handguard does not cut the ribbon-like handles of a plastic bag. Similarly, the side edges 15 of the palm guard 12 and finger guard 18 may be curled inward so as not to cut the user's hand.

A method of fabricating the handguard 10 by heating and bending is illustrated in FIG. 1B, showing an elongated plastic sheet material 24 having a width 26 defining a top edge 28 and a bottom edge 30. The sheet material 24 is bent under application of heat, at line 32 forming the top radius 14 and flap 16 of FIG. 1A, the bending performed to a degree that the top edge 28 is positioned a spacing 34 from the back 12. The bottom edge 30 is then bent upwardly upon application of heat towards the top edge 28 of flap 16 forming the bottom grip radius or U-shaped bridge member 20 and finger guard 18 of FIG. 1A, overlapping and making contact with the flap 16. Alternately, the handguard may be injected molded as a single piece. In yet another alternate fabrication method, the handguard may be formed as a single lengthwise extrusion which is then cut at regular intervals, corresponding to a desired width dimension. It is understood that the above description is not intended as an exhaustive list but merely illustrative examples of some of the possible fabrication methods for the handguard of the present invention.

The length 36 of the keeper flap 16 is selected so that with a particular selected material 24, a user can easily inwardly depress and bend the flap 16 with minimal thumb pressure to a degree that the top edge makes contact with the back 12, opening a gap approximately equal to spacing 34 between the top edge 28 and bottom edge 30. The desired plastic sheet material should have sufficient resilience or elastic memory so that it will return to its original point of contact with the bottom edge 30 when pressure thereagainst by a user's thumb, for example, is released.

The curvature of the bottom grip radius or bridge member 20 is selected to provide comfort when bearing on a user's gripping fingers, and the bridge member 20 and trough. 22 are formed so as to provide sufficient space for the loop ends of a number of plastic grocery bags or other types of thin handles such as those formed from wire or cord.

The overall height 40 of the palm guard 12 is preferably of a dimension to fit between the base of a user's fingers and base of the thumb, as will be more clearly described in the following.

Figure 2:
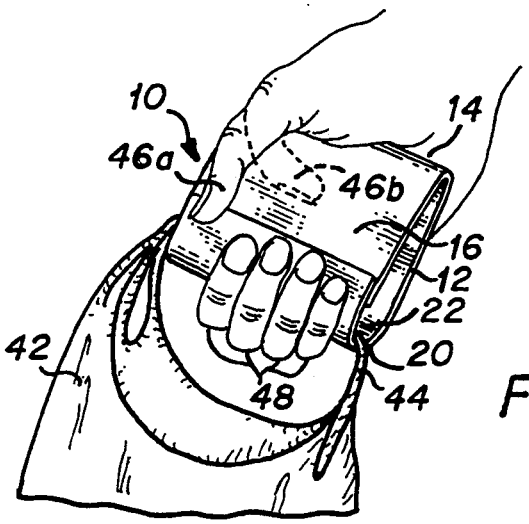
FIG. 2 is a perspective view of the handguard shown in use for carrying the handles of a plastic bag.

Referring now to FIG. 2 of the drawing, the handguard 10 is shown in the typical application of carrying a plastic grocery bag 42. Elements of particular interest in the illustration further include the grocery bag handle 44, the user's thumb in a first use position 46*a* and second use position 46*b* (in phantom), fingers 48, and handguard elements consisting of: palm guard 12, keeper flap 16; trough 22; gap 38; top radius 14; and the U-shaped bridge member 20. In operation, a user positions the handguard with the palm guard 12 against his palm, with the top radius 14 under the base of the thumb 46. The top radius 14 functions as a hinge member for the keeper flap 16 which is spring biased upon formation to abut against the finger guard 18. The bridge member 20 bears against the fingers carrying the load. Initially, a user maneuvers the handguard so that the thumb 46 can depress the keeper flap 16, illustrated for example by thumb position 46*b*, moving it towards the palm guard 12 thus creating an opening or gap for receiving the loop ends 44 of a plastic bag 42. The full open position for the keeper flap 16 is shown in phantom in FIG. 1A. The weight of the plastic bag and its contents bears upon the trough 22 of bridge member 20 and pressure is spread over a considerable area of the user's fingers 48. The thumb is then moved to position 46*a* for a typical comfortable and controlled carrying position for the handguard 10.

Removal of the bag handles is accomplished by inwardly depressing the flap 16 and simply lifting the loop ends or handles up and out, or by lowering the grip depending on the type of container and load being carried. The latter removal method facilitates single hand operation. The closure of keeper flap 16 assures the security of a number of handles in the trough 22, such as a quantity of plastic grocery bags, making it possible to set the bags down and pick them up again without resetting the handguard 10.

Figure 3A:
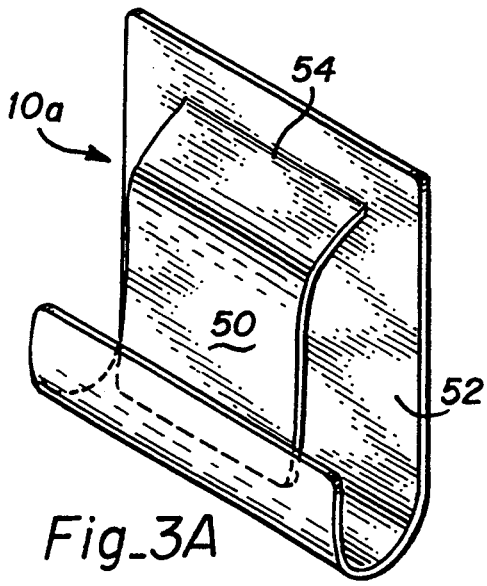
FIGS. 3A–3D are a series of perspective views, each showing an alternate embodiment for the handguard of the present invention.
Figure 3B:
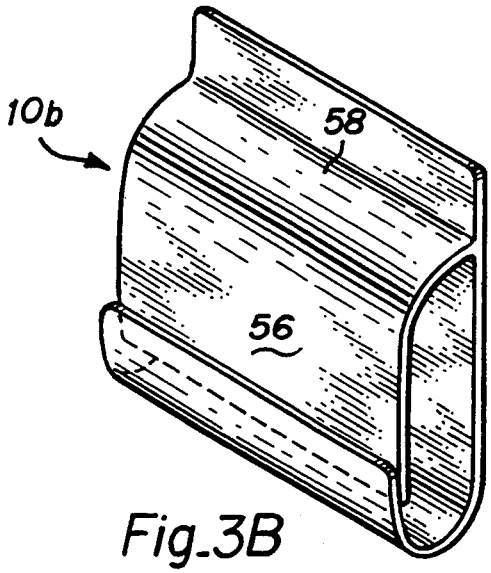
Figure 3C:
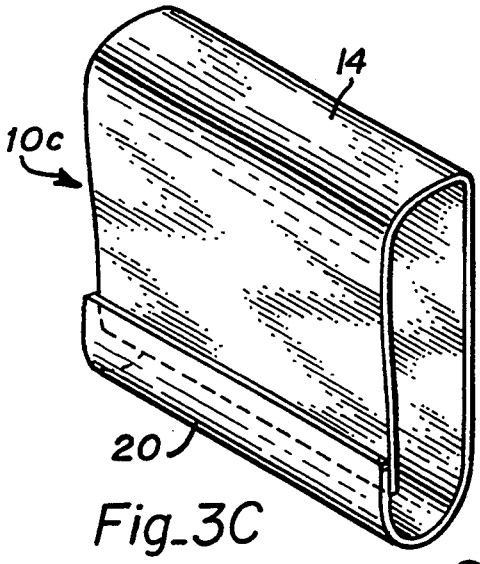

Referring now to FIGS. 3A–3D, there are shown respective alternate embodiments of the invention 10*a*, 10*b*, 10*c* and 10*d*. FIG. 3A shows the hinge 14 and keeper flap 16 of FIG. 1 replaced with a keeper flap 50 integrally connected to an upper flat portion of the palm guard 52 at a junction 54. The handguard 10*b* of FIG. 3B is similar to the handguard 10*a* of FIG. 3A except that the width of the keeper flap 56 is equal to the width of the palm guard 58. Generally speaking, in view of their design, the embodiments 10*a* and 10*b* of FIGS. 3A and 3B, respectively, require a greater amount of force to depress the keeper flaps 50, 56 to the open position. Also as before, the embodiment of FIG. 3B shows an optional hole 57 provided in the palm guard 58 for hanging on a hook for storage after use or for retail display. FIG. 3C shows a handguard 10*c* similar to that of FIG. 1 except that the curvature of the top radius 14 is similar to that of the bottom grip radius 20.

Figure 3D:
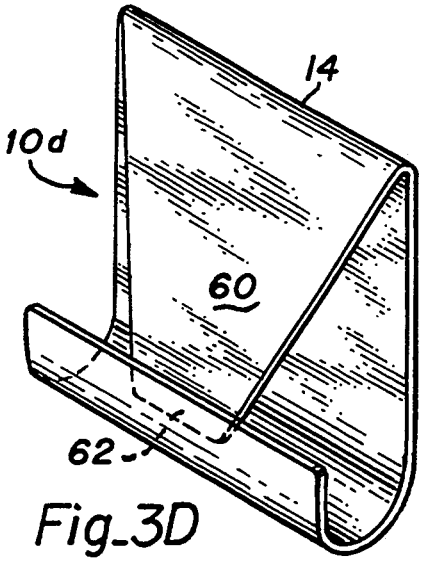

FIG. 3D shows a further alternate embodiment 10*d* wherein the keeper flap 60 is tapered from the top radius 14 to the bottom edge 62. This design is particularly useful to control the spring tension of the flap 60.

Figure 4:
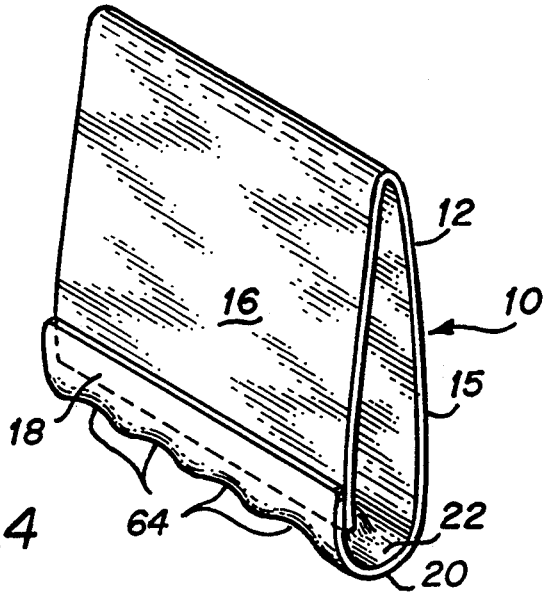
FIG. 4 is a perspective view of the handguard of FIG. 1A shown with an undulating finger gripping surface provided to the bottom grip radius.

FIG. 4 shows an alternate shape of the bottom grip radius 64 portion having an undulating surface to conform more fully with the contour of a user's fingers and thereby further reducing pressure on the user's hands. This alternative is more costly to manufacture, but has application with very heavy loads, or where the load must be carried for a long duration.

It should be understood that various modifications within the scope of this invention can be made by one of ordinary skill in the art without departing from the spirit thereof. I therefore wish my invention to be defined by the scope of the appended claims as broadly as the prior art will permit, and in view of the specification if need be.

| PARTS LIST | |
|---|---|
| 10 | handguard |
| 12 | palm guard |
| 13 | hole |
| 14 | top radius (hinge) |
| 16 | keeper flap |
| 17 | lower portion |
| 18 | finger guard |
| 20 | bridge member |
| 21 | flared side edge |
| 22 | trough |
| 24 | material |
| 26 | width |
| 28 | top edge |
| 30 | bottom edge |
| 32 | line |
| 34 | spacing |
| 36 | length of flap |
| 40 | height |
| 42 | plastic grocery sack |
| 44 | grocery sack handle |
| 46a | thumb position 1 |
| 46b | thumb position 2 |
| 48 | fingers |
| 50 | flap |
| 52 | back |
| 54 | junction |

-continued

| PARTS LIST | |
|---|---|
| 56 | flap |
| 57 | hole |
| 58 | back |
| 60 | flap |
| 62 | top edge |

I claim:

1. A handguard for carrying plastic bags and like carrying articles having thin loop-type carrying handles comprising in operative combination:

a) a single elongated sheet of plastic material having a width dimension about as wide as an adult user's hand, said elongated sheet including:

i) a finger guard portion having a top edge portion and a bottom end portion;

ii) a palm guard portion having a top end portion and a bottom end portion, said top end portion spaced at a vertical distance roughly equal to the length of an adult user's palm;

iii) a U-shaped bridge member connecting the bottom end portions of said finger guard portion and said palm guard portion, said U-shaped bridge member having an outer gripping surface and an inner trough having a radius of curvature sized for receiving a plurality of thin loop-type bag handles;

iv) a keeper flap portion disposed extending between said finger guard portion and said palm guard portion and having a top end portion connected to said top end portion of said palm guard portion defining a rigid inverted substantially V-shaped connection and a bottom free end portion disposed extending downwardly a distance for abutment against an inner surface of said top edge portion of said finger guard portion, said keeper flap portion having a vertical length greater than half as long as a corresponding vertical length of said palm guard portion; and b) whereby said V-shaped connection normally biases said keeper flap portion to a closed position such that said keeper flap bottom end portion is retainingly engaged by abutment against said finger guard top edge portion and is inwardly movable by thumb pressure in a direction toward said palm guard portion thereby permitting single-handed opening and closing operation of said handguard for receiving bag handles.

2. A handguard for plastic bag handles as in claim 1 wherein said palm guard portion includes a hole sized for receiving a storage hook.

3. A handguard for plastic bag handles as in claim 2 wherein said U-shaped bridge member includes tapered side edges to protect against tearing of said bag handles when received within said inner trough.

4. A handguard for plastic bag handles as in claim 3 wherein said keeper flap portion includes opposed side edges which taper inwardly from said keeper flap top end portion to said keeper flap bottom end portion.

5. A handguard for plastic bag handles as in claim 1 wherein said keeper flap portion includes a hole sized for receiving a storage hook.

6. A handguard for plastic bag handles as in claim 5 wherein said U-shaped bridge member includes tapered side edges to protect against tearing of said bag handles when received within said inner trough.

7. A handguard for plastic bag handles as in claim 6 wherein said keeper flap portion includes opposed side edges which taper inwardly from said keeper flap top end portion of said keeper flap bottom end portion.

8. A handguard for plastic bag handles as in claim 1 wherein said U-shaped bridge member includes tapered side edges to protect against tearing of said bag handles when received within said inner trough.

9. A handguard for plastic bag handles as in claim 8 wherein said keeper flap portion includes opposed side edges which taper inwardly from said keeper flap top end portion to said keeper flap bottom end portion.

10. A handguard for plastic bag handles as in claim 1 wherein said keeper flap portion includes opposed side edges which taper inwardly from said keeper flap top end portion to said keeper flap bottom end portion.

11. A handguard for plastic bag handles as in claim 1 wherein said outer gripping surface of said bridge member includes a plurality of finger support areas positioned over a longitudinal length of said bridge member to facilitate user handling.

12. A handguard for carrying plastic bag handles and like carrying articles having thin loop-type carrying handles comprising in operative combination:

a) an upstanding finger guard portion having a tope edge portion and a bottom end portion;

b) an upstanding palm guard portion having a top end portion and a bottom end portion, said top end portion spaced at a vertical distance roughly equal to the length of an adult user's palm;

c) a U-shaped bridge member connecting the bottom end portions of said finger guard portion and said palm guard portion, said U-shaped bridge member having an outer gripping surface and an inner trough having a radius of curvature sized for receiving a plurality of bag handles;

d) a keeper flap portion disposed extending between said finger guard portion and said palm guard portion and having atop end portion integrally connected to a first wall surface of said palm guard portion thereby defining a rigid inverted substantially V-shaped connection and a bottom end portion extending downwardly a distance for abutment against an inner surface of said top edge portion of said finger guard portion, said keeper flap portion having a vertical length greater than half as long as a corresponding vertical length of said palm guard portion; and e) said rigid V-shaped connection normally biases said keeper flap portion to a closed position such that said keeper flap bottom end portion is retainingly engaged by abutment against said finger guard top edge portion and is inwardly movable by thumb pressure in a direction toward said palm guard portion thereby permitting single-handed opening and closing operation of said handguard for receiving bag handles.

13. A handguard for plastic bag handles as in claim 12 wherein said palm guard portion includes a hole sized for receiving a storage hook.

14. A handguard for plastic bag handles as in claim 13 wherein said U-shaped bridge member includes tapered side edges to protect against tearing of said bag handles when received within said inner trough.

15. A handguard for plastic bag handles as in claim 14 wherein said keeper flap portion includes opposed side edges which taper inwardly from said keeper flap top end portion to said keeper flap bottom end portion.

16. A handguard for plastic bag handles as in claim 12 wherein said U-shaped bridge member includes tapered side edges to protect against tearing of said bag handles when received within said inner trough.

17. A handguard for plastic bag handles as in claim 16 wherein said keeper flap portion includes opposed side edges which taper inwardly from said keeper flap top end portion to said keeper flap bottom end portion.

18. A handguard for plastic bag handles as in claim 12 wherein said keeper flap portion includes opposed side edges which taper inwardly from said keeper flap top end portion to said keeper flap bottom end portion.

19. A handguard for carrying plastic bag handles as in claim 12 wherein said handguard is formed as a single injection molded plastic piece.

20. A handguard for plastic bag handles as in claim 12 wherein said outer gripping surface of said bridge member includes a plurality of finger support areas positioned over a longitudinal length of said bridge member to facilitate user handling.

* * * * *